United States Patent [19]

Koizumi

[11] Patent Number: 4,745,325

[45] Date of Patent: May 17, 1988

[54] HEATER FOR INDIRECT-HEATED CATHODE

[75] Inventor: Sachio Koizumi, Mobara, Japan

[73] Assignee: Hitachi, Ltd., Tokyo, Japan

[21] Appl. No.: 810,716

[22] Filed: Dec. 19, 1985

[30] Foreign Application Priority Data

Dec. 26, 1984 [JP] Japan ..... 59-272801

[51] Int. Cl.[4] ..... H01J 1/14; H01J 17/06

[52] U.S. Cl. ..... 313/345; 313/337; 313/341; 313/343; 313/344; 313/354; 313/591; 313/629; 427/111; 428/606

[58] Field of Search ..... 313/337, 341, 343, 344, 313/345, 354, 591, 629, 37; 427/111; 428/606

[56] References Cited

U.S. PATENT DOCUMENTS

| | | | |
|---|---|---|---|
| 2,103,068 | 12/1937 | Fehse et al. | 313/629 |
| 2,155,237 | 4/1939 | Perrott | 313/629 |
| 2,194,678 | 3/1940 | Somers | 313/629 |
| 3,356,883 | 12/1967 | Menelly et al. | 313/629 |
| 4,427,916 | 1/1984 | Shroff | 313/345 |

FOREIGN PATENT DOCUMENTS

| | | | |
|---|---|---|---|
| 0133726 | 10/1986 | Japan | 313/345 |
| 863084 | 3/1961 | United Kingdom . | |
| 891913 | 9/1962 | United Kingdom . | |
| 922412 | 2/1963 | United Kingdom . | |
| 971836 | 7/1964 | United Kingdom . | |
| 1001922 | 10/1965 | United Kingdom . | |
| 1346745 | 3/1974 | United Kingdom . | |

*Primary Examiner*—David K. Moore
*Assistant Examiner*—Michael J. Nickerson
*Attorney, Agent, or Firm*—Antonelli, Terry & Wands

[57] ABSTRACT

Disclosed is a heater for indirect-heated cathode having a heating element composed of a wire with a high specific resistance, such as titanium or titanium-based alloy, around which another wire with a low specific resistance is wound, and having a heat-resisting insulating material covering at least part of said heating element.

6 Claims, 2 Drawing Sheets

HEATER FOR INDIRECT-HEATED CATHODE

BACKGROUND OF THE INVENTION

This invention relates to a heater for an indirect-heated cathode which is difficult to disconnect and is very reliable.

Conventional heaters for indirect-heated cathodes which have been generally used are manufactured through the following process.

(1) A tungsten wire (or a wire containing tungsten as the main component) (12) is wound around the molybdenum (or alloy containing molybdenum as the main component) wire (11) at a predetermined pitch as shown in FIG. 1*a*.

(2) After finishing the above process, the above two wires are formed into the shape shown in FIG. 1*b*.

(3) After forming the shape in the above step (2), alumina having the appropriate particle size is coated on the wires through for example electrodeposition.

(4) Under a reducing atmosphere in which tungsten cannot be oxidized, the alumina coating is sintered for example at a temperature of 1650 degrees C. to strengthen the alumina coating.

(5) The molybdenum core wire is dissolved and removed in strong acid (for example, mixed solution of hydrochloric acid and nitric acid) to thereby obtain a heater with the appearance shown in FIG. 1*c*. The schematic cross section of A—A line in FIG. 1*c* is shown in FIG. 1*d*. In these drawings, (11) is a molybdenum wire, (12) is tungsten wire, (33) is alumina covering, and (34) is the hollow portion.

Since the heating portion can be concentrated near the point to be heated in the indirect-heated cathode in the heater thus manufactured, an indirect-heated cathode with good electron emission can be obtained with comparatively low electric power.

On the other hand, the portion which has been left after dissolving and removing the molybdenum wire as shown in FIG. 1*d* has become hollow and the mechanical strength of the heater is decreased.

If the heater is used for a cathode ray tube, a short-circuit current melts the tungsten wire when flashover occurs in the tube. Also, the difference in thermal expansion coefficient exerts repeated tensile stress on the tungsten wire from alumina, causing the tungsten wire to disconnect. These problems occur in conventional heaters.

SUMMARY OF THE INVENTION

The object of this invention is to provide a very reliable heater for an indirect-heated cathode which has high mechanical strength and is difficult to disconnect, eliminating the above-mentioned defects of a conventional heater for indirect-heated cathode.

To accomplish the above-mentioned object, a heating element is composed of a wire with a high specific resistance around which other another wire with a low specific resistance is wound, in the present invention. The partial or entire surface of this heating element is covered with heat-resisting insulating material, after being formed into a predetermined shape if necessary. Also, there is not adopted the conventional process to generate a hollow portion within the heater after completion, by dissolving and removing the molybdenum core wire.

A wire with a high specific resistance used inside will reinforce the mechanical strength of the other wire, for example the tungsten wire with a low specific resistance which is wound around it and which is actually heated. Also, since the heat capacity has increased, it will restrain disconnection due to tensile stress from the alumina caused by the difference in thermal expansion coefficient when the temperature rises. Further, and fusion accidents due to a short-circuit current when flashover occurs in the cathode ray tube are also prevented. As a wire having a high specific resistance to be used inside, any metallic or insulation material can be employed provided it is strong enough to withstand the process of forming to some extent.

In prior art devices, the heater foot areas have conventionally been wound in triplicate as a countermeasure against fusion when flashover occurs within the cathode ray tube. This countermeasure is not necessary in the present invention. Abolishment of triple coil winding operations and of molybdenum core wire dissolving and removal operations reduce processing costs.

The specific resistance value of the above-mentioned wire with a high specific resistance can be preferably 1000 times or more that of the above-mentioned wire with a low specific resistance, or more preferably 10000 times or more. For the above-mentioned wire with a low specific resistance, conventional electric heating materials such as tungsten and nichrome (60 wt % Ni-16 wt % Cr-Fe alloy) may be used. For the above-mentioned wire with a high specific resistance, a material such as titanium or titanium-base alloy may be used, however, it is not necessary to limit to these.

The construction of the heater for an indirect-heated cathode of the present invention is generally similar as that of conventional one except that the hollow portion formed by dissolving the core wire conventionally is replaced; with a wire with a high specific resistance in the present invention.

DESCRIPTION OF THE PREFERRED EMBODIMNETS

The embodiment of the present invention will be described below using FIG. 2*a* to FIG. 2*d*.

Figure 1A:
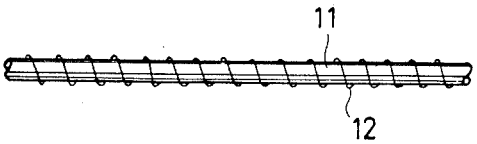
FIG. 1a PRIOR ART
FIG. 1*a*, FIG. 1*b* and FIG. 1*c* are plan views showing a manufacturing process of conventional heaters for indirect-heated cathodes.
Figure 1B:
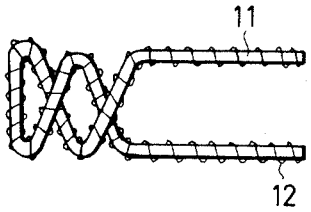
FIG. 1b PRIOR ART
Figure 1C:
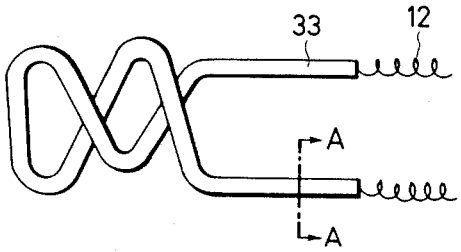
FIG. 1c PRIOR ART
Figure 1D:
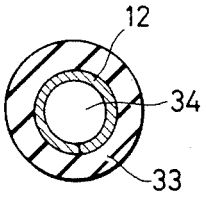
FIG. 1d PRIOR ART
FIG. 1*d* is a schematic cross section of a conventional heater for indirect-heated cathode.
Figure 2A:
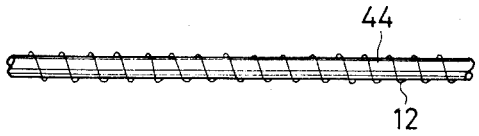
FIG. 2*a*, FIG. 2*b* and FIG. 2*c* are plan views showing the manufacturing process of the heater for indirect-heated cathode in an embodiment of the present invention.

Titanium wire with a diameter of 0.14 mm can be used as a wire with a high specific resistance (44), and tungsten wire (12) with a diameter of 0.04 mm as the other wire with a low specific resistance which is wound around the wire (44) as shown in FIG. 2*a* to make the heating element. The specific resistances of the titanium wire and tungsten wire are $4.7\times10^{5}$ Ωcm and $5.6\times10^{-6}$ Ωcm, respectively. 10 turns of the above tungsten wire were wound per 1 mm of titanium wire.

Figure 2B:
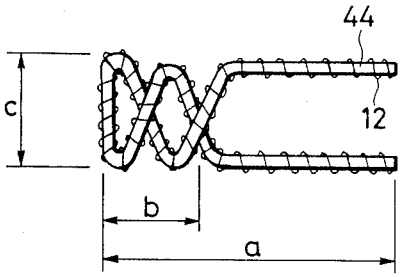
Figure 2C:
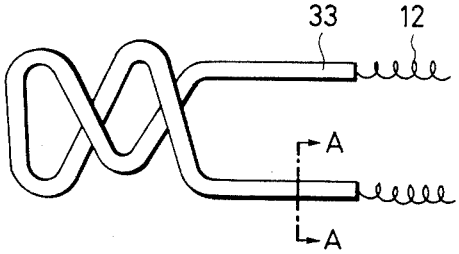

Then, after forming the above heating element into the shape shown in FIG. 2*b*, the wires are covered with alumina which is sintered in the same manner as for conventional processes to make the heater for indirect-heated cathode in this embodiment shown in FIG. 2c. FIG. 2c shows the heater for indirect-heated cathode after completion of this embodiment. Symbol (33) indicates the alumina covering.

Figure 2D:
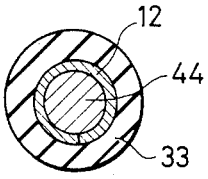
FIG. 2*d* is a schematic cross section of the heater for indirect-heated cathode in an embodiment of the present invention.

A—A line cross section in FIG. 2c, viz. the schematic cross section of the heater after completion is shown in FIG. 2d. For the dimensions of the heating element after forming, a, b, and c are 13.0 mm, 2.0 mm and 1.5 mm, respectively. In FIG. 2a to FIG. 2d, (12) is tungsten wire, (33) is the alumina covering, and (44) is wire with a high specific resistance (titanium wire in this embodiment).

Conventionally, dissolving and removing operations for the molybdenum core wire were required after sintering the alumina covering (33). However, the present invention does not need such operations.

As the cross section of the heater after completion, the wire with a high specific resistance (44) remains as is in the position which would have been hollow in conventional heaters as shown in FIG. 2d. Since the wire with a high specific resistance (44) remains as the core, a heater with high mechanical strength is obtained, with the results that a cracked alumina covering which conventionally occurred during handling such as carrying and during welding operations for the heater pedestal portion will be reduced, and fusion accidents due to short-circuit currents will be decreased.

When the heater in this embodiment was mounted in a color picture tube for operation, no fusion accidents of the heater occurred even though the heater foot portion was not wound in triplicate.

As explained above, in the heater for indirect-heated cathode of the present invention, the heater's mechanical strength increases, cracked alumina coverings are reduced, overall heat capacity increases, fusion accidents due to short-circuit current during flashover reduced, effects of stress from differences in thermal expansion with alumina coverings are also reduced, and yet core wire dissolving and removal operations are not required, reducing manufacturing costs.

Incidentally, in the heater for indirect-heated cathode of the present invention, conventional knowledge and known teachings may be adopted in connection with the present invention including matters not specifically described in the present specification.

What is claimed is:

1. A heater for an indirect-heated cathode having a heating element composed of a first wire with a high specific resistance around which a second wire with a low specific resistance is wound, at least part of said heating element being covered with a heat-resisting insulating material.

2. The heater of claim 1, wherein said second wire with a low specific resistance is tungsten wire.

3. A heater for an indirect-heated cathode having a heating element composed of a first wire with a high specific resistance around which a second wire with a low specific resistance is wound, at least part of said heating element being covered with a heat-resisting insulating material, wherein said first wire with a high specific resistance is titanium or titanium-base alloy wire.

4. A heater for an indirect-heated cathode having a heating element composed of a first wire with a high specific resistance around which a second wire with a low specific resistance is wound, at least part of said heating element being covered with a heat-resisting insulating material, wherein said second wire with a high specific resistance is tungsten wire, and said first wire with a high specific resistance is titanium or titanium-base alloy wire.

5. A heater for an indirect-heated cathode having a heating element composed of a first metal wire with a high specific resistance around which a second wire with a low specific resistance is wound, at least part of said heating element being covered with a heat-resisting insulating material, said high specific resistance being 1000 or more times higher than said low specific resistance.

6. A heater of claim 5, wherein said wire with a low specific resistance is tungsten wire.

* * * * *